US006984033B2

(12) United States Patent
Bringley et al.

(10) Patent No.: US 6,984,033 B2
(45) **Date of Patent: *Jan. 10, 2006**

(54) INK JET PRINTING METHOD

(75) Inventors: Joseph F. Bringley, Rochester, NY (US); Krishamohan Sharma, Rochester, NY (US); Christine Landry-Coltrain, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 198 days.

This patent is subject to a terminal disclaimer.

(21) Appl. No.: 10/180,187

(22) Filed: Jun. 26, 2002

(65) Prior Publication Data

US 2004/0201665 A1 Oct. 14, 2004

(51) Int. Cl.
*B41M 5/00* (2006.01)

(52) U.S. Cl. ..... 347/105; 428/32.14; 428/32.15; 428/32.34

(58) Field of Classification Search ..... 428/32.14, 428/32.15, 32.34, 32.11, 32.19; 347/105
See application file for complete search history.

(56) References Cited

U.S. PATENT DOCUMENTS 5,500,668 A * 3/1996 Malhotra et al. ..... 347/105
6,800,267 B2 * 10/2004 Schubert et al. ..... 423/335

FOREIGN PATENT DOCUMENTS

EP 1 174 279 A1 1/1999
EP 0 988 993 A1 3/2000
EP 0 893 270 A1 1/2002

* cited by examiner

*Primary Examiner*—Pamela R. Schwartz
(74) *Attorney, Agent, or Firm*—Harold E. Cole; Chris P. Konkol

(57) ABSTRACT

An ink jet printing method comprising the steps of: A) providing an ink jet printer that is responsive to digital data signals; B) loading the printer with an ink jet recording element comprising a support having thereon an image-receiving layer, the ink jet recording element containing a metal hydroxide salt, $(M^{2+})(OH)_a(A^{p-})_b.xH_2O$; wherein: $M^{2+}$ is at least one metal ion having a 2+ oxidation state; A is an organic or inorganic anion; p is 1 or 2; and x is equal to or greater than 0; and a and b comprise rational numbers as follows: $0<a<2$ and $0<b<2$ so that the charge of $M^{2+}$ is balanced; C) loading the printer with an ink jet ink composition; and D) printing on the ink jet recording element using the ink jet ink composition in response to the digital data signals.

17 Claims, No Drawings

INK JET PRINTING METHOD

CROSS REFERENCE TO RELATED APPLICATIONS

Reference is made to commonly assigned, co-pending U.S. patent applications:

Ser. No. 10/180,182 by Sharma et al., filed of even date herewith entitled "Ink Jet Recording Element";

Ser. No. 10/180,638 by Sharma et al., filed of even date herewith entitled "Ink Jet Recording Element"; and Ser. No. 10/180,373 by Bringley et al., filed of even date herewith entitled "Ink Jet Printing Method";

Ser. No. 10/180,752 by Sharma et al., filed of even date herewith entitled "Ink Jet Recording Element";

Ser. No. 10/180,184 by Bringley et al., filed of even date herewith entitled "Ink Jet Printing Method";

Ser. No. 10/180,395 by Sharma et al., filed of even date herewith entitled "Ink Jet Recording Element"; and Ser. No. 10/180,179 by Bringley et al., filed of even date herewith entitled "Ink Jet Printing Method".

FIELD OF THE INVENTION

The present invention relates to an ink jet printing method using an ink jet recording element containing a stabilizer.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by coating in which a particulate-containing coating is applied to a support and is dried.

When a porous recording element is printed with dye-based inks, the dye molecules penetrate the coating layers. However, there is a problem with such porous recording elements in that the optical densities of images printed thereon are lower than one would like. The lower optical densities are believed to be due to optical scatter which occurs when the dye molecules penetrate too far into the porous layer. Another problem with a porous recording element is that atmospheric gases or other pollutant gases readily penetrate the element and lower the optical density of the printed image causing it to fade.

EPA 1174279A teaches the use of zinc oxide in ink jet recording elements to improve light stability. However, there is problem with such elements in that they do not provide protection against environmental gasses such as ozone.

EPA 988993A and EPA 893270A disclose the use of aluminum hydrate and aluminum hydroxides in ink jet recording elements. However, there is a problem with these elements in that they do not provide good image stability.

It is an object of this invention to provide an ink jet printing method using an ink jet recording element that, when printed with dye-based inks, provides superior optical densities, good image quality and has an excellent dry time.

SUMMARY OF THE INVENTION

This and other objects are achieved in accordance with the invention which comprises an ink jet printing method comprising the steps of A) providing an ink jet printer that is responsive to digital data signals;

B) loading the printer with an ink jet recording element comprising a support having thereon an image-receiving layer, the ink jet recording element containing a metal hydroxide salt, $$(M^{2+})(OH)_a(A^{p-})_b.xH_2O;$$

wherein:

$M^{2+}$ is at least one metal ion having a 2+ oxidation state;

A is an organic or inorganic anion;

p is 1 or 2; and x is equal to or greater than 0; and and b comprise rational numbers as follows: $0<a<2$ and $0<b<2$ so that the charge of $M^{2+}$ is balanced;

C) loading the printer with an ink jet ink composition; and

D) printing on the ink jet recording element using the ink jet ink composition in response to the digital data signals.

By use of the invention, an ink jet recording element is obtained that, when printed with dye-based inks, provides superior optical densities, good image quality and has an excellent dry time.

DETAILED DESCRIPTION OF THE INVENTION

In a preferred embodiment of the invention, the metal hydroxide salt described above is located in the image-receiving layer. In another preferred embodiment, M can be two different metal ions such as zinc and tin. In another preferred embodiment, the metal hydroxide salt described above is in a particulate form. In another preferred embodiment, a is greater than 0.5 and b is less than 1.5.

In yet still another preferred embodiment of the invention, $A^{p-}$ is an organic anion such as R—$COO^-$, R—$O^-$, R—$SO_3^-$, R—$OSO_3^-$ or R—O—$PO_3^-$ where R is an alkyl or aryl group. In another preferred embodiment, $A^{p-}$ is an inorganic anionic such as $I^-$, $Cl^-$, $Br^-$, $F^-$, $ClO_4^-$, $NO_3^-$, $CO_3^{2-}$ or $SO_4^{2-}$. The particle size of the salt described above is less than about 5 $\mu$m, preferably less than about 1 $\mu$m.

$M^{2+}$ hydroxide salts can be synthesized from a variety of synthetic routes, such as addition of base to metal salts, reacting a metal salt with a metal oxide or through ion exchange. Some of the $M^{2+}$ hydroxide salts form layered structures and are commonly referred to as hydroxy double salts. However, $M^{2+}$ hydroxides can also exist as polycationic nanoparticles. It is possible to control particle size, shape and structure of $M^{2+}$ hydroxide salts using appropriate anions or metal ions or synthetic routes.

Examples of $M^{2+}$ useful in the invention include zinc, magnesium, barium, calcium, tin, nickel, cobalt and copper.

Specific examples of $M^{2+}$ hydroxide salts include zinc hydroxy double salts such as $Zn_5(OH)_8(A^{p-})$, wherein $A^{p-}$ is Cl, Br, nitrate, acetate or propionate.

In a preferred embodiment of the invention, the image-receiving layer is porous and also contains a polymeric binder in an amount insufficient to alter the porosity of the porous receiving layer. In another preferred embodiment, the polymeric binder is a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, or a poly (alkylene oxide). In yet still another preferred embodiment, the hydrophilic binder is poly(vinyl alcohol).

In addition to the image-receiving layer, the recording element may also contain a base layer, next to the support, the function of which is to absorb the solvent from the ink. Materials useful for this layer include particles, polymeric binder and/or crosslinker.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include inorganic or organic particles, pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific elements are described in MCCUTCHEON's Volume 1: Emulsifiers and Detergents, 1995, North American Edition.

The ink receiving layer employed in the invention can contain one or more mordanting species or polymers. The mordant polymer can be a soluble polymer, a charged molecule, or a crosslinked dispersed microparticle. The mordant can be non-ionic, cationic or anionic.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples are provided to illustrate the invention.

EXAMPLES

Example 1

Dye Stability Evaluation Tests

The dye used for testing was a magenta colored ink jet dye having the structure shown below. To assess dye stability on a given substrate, a measured amount of the ink jet dye and solid particulates or aqueous colloidal dispersions of solid particulates (typically about 10%–20.0% by weight solids) were added to a known amount of water such that the concentration of the dye was about $10^{-5}$ M. The solid dispersions containing dyes were carefully stirred and then spin coated onto a glass substrate at a speed of 1000–2000 rev/min. The spin coatings obtained were left in ambient atmosphere with fluorescent room lighting (about 0.5 Klux) kept on at all times during the measurement. The fade time was estimated by noting the time required for complete disappearance of magenta color as observed by the naked eye or by noting the time required for the optical absorption to decay to less than 0.03 of the original value. The results are shown in Table 1.

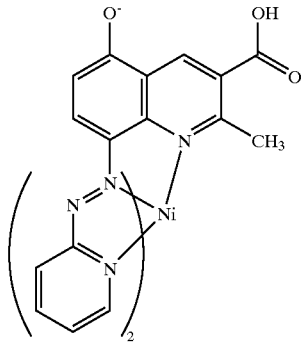

Magenta Dye

Comparative Coatings C-1 to C-6 (Non-metal$^{2+}$ Hydroxide Salts)

Inorganic particles of $Al_2O_3$, $SiO_2$, ZnO, $Zn(OH)_2$, laponite and montmorillonite were purchased from commercial sources as fine particles or as colloidal particulate dispersions and were used to evaluate the stability of ink jet dyes in comparison with the materials employed in the present invention. The particulates were then coated and tested as described above.

Inventive Coatings I-1 to I-7

I-1. 81.5 g of ZnO (1.0 mol) (J.T. Baker Co.) was suspended in 100 ml of distilled deionized water. To this suspension, 148.5 g of $Zn(NO_3)_2.6H_2O$ (0.5 mol) dissolved in 500 mL of distilled deionized water was added rapidly (within 5–10 min.). The resultant suspension was stirred vigorously for five days at 60° C. The final product, $Zn_5(OH)_8(NO_3)_2.2H_2O$, was filtered and washed with copious amounts of distilled water and air dried. The final product was dispersed in distilled water and used for evaluating the stability of ink jet dyes as described above.

I-2. 162.8 g of ZnO (2.0 mol) (J.T. Baker Co.) was suspended in 200 ml of distilled deionized water. To this suspension, 219.5 g of $Zn(CH_3COO)_2.6H_2O$ (1.0 mol) dissolved in 500 mL of distilled deionized water was added rapidly (within 5–10 min). The resultant suspension was stirred vigorously 36 h at 60° C. The final product, $Zn_5(OH)_8(CH_3COO)_2.2H_2O$ was filtered and washed with copious amounts of distilled water and air dried. The final product was dispersed in distilled water and used for evaluating the stability of ink jet dyes as described above.

I-3. 40.6 g of ZnO (0.5 mol), (Alfa Aesar Co.), 325 mesh powder, was suspended in 50 ml of distilled deionized water. To this suspension, 35.5 g of $ZnCl_2$ (0.26 mol) dissolved in 250 mL of distilled deionized water was added rapidly (within 5–10 min.). The resultant suspension was stirred vigorously for two days at room temperature. The final product, $Zn_5(OH)_8(Cl)_2.2H_2O$, was filtered and washed with copious amounts of distilled water and air dried. The final product was dispersed in distilled water and used for evaluating the stability of ink jet dyes as described above.

I-4. 40.6 g of ZnO (0.5 mol), (Alfa Aesar Co.), 325 mesh powder, was suspended in 50 ml of distilled deionized water. A separate solution was made by dissolving 70.0 g of $Zn(NO_3)_2$ (0.0235 ml) and 4.5 g of $Co(NO_3)_2$ (0.0015 mol) in 250 mL of distilled deionized water. The mixed metal nitrate solution was filtered and then added rapidly to this suspension of ZnO. The final reaction mixture was vigorously stirred for two days at room temperature. The product, $(Zn_{5-x}, Co_x)(OH)_8(NO_3)_2.2H_2O$: was filtered and washed with copious amounts of distilled water and air dried. The final product was dispersed in distilled water and used for evaluating the stability of ink jet dyes as described above.

I-5. 20.35 g of ZnO (0.25 mol), (JT Baker Co.) was suspended in 50 ml of distilled deionized water. To this suspension, 23.1 g of zinc sulfate mono hydrate (0.128 mol) dissolved in 125 mL of distilled deionized water was added rapidly (within 5–10 min.). The resultant suspension, $3Zn(OH)_2.ZnSO_4.4H_2O$, was stirred vigorously for two days at room temperature. The final product was dispersed in distilled water and used for evaluating the stability of ink jet dyes as described above.

I-6. Fine particles of $[Zn_5(OH)_8(NO_3)_2].xH_2O$ (5.0 g, 0.008 mol) were suspended in 200 ml of distilled water. To this suspension 4.0 g of 1-napthalene sulfonic acid sodium salt (0.017 mol) was added while vigorously stirring the suspension at 60° C. The stirring was continued for 2 days and the final product, $Zn_5(OH)_8(\text{napthalene sulfonate})_y$ was filtered and washed with copious amounts of acetone and air dried. The final product was dispersed in distilled water and used for evaluating the stability of ink jet dyes as described above.

I-7. Fine particles of $[Zn_5(OH)_8(NO_3)_2].xH_2O$ (5.0 g, 0.008 mol) were suspended in to 200 ml of distilled water. To this suspension 2.5 g of salicylic acid (0.0018 mol) was added at room temperature and the reaction mixture was stirred for 2 days. The final product of this reaction is a physical mixture of hydroxy double salt containing nitrate and salicylate anions, $[Zn_5(OH)_8(\text{salicylate})_y]_x[Zn_5(OH)_8(NO_3)]_{1-x}$. The final product was dispersed in distilled water and used for evaluating the stability of ink jet dyes as described above.

TABLE 1

| Coating | Particle | Fade Time |
|---|---|---|
| C-1 | $Al_2O_3$ | 18 hours |
| C-2 | $SiO_2$ | 18 hours |
| C-3 | ZnO | 2 days |
| C-4 | $Zn(OH)_2$ | 5 days |
| C-5 | Laponite | 4 days |
| C-6 | Montmorillonite | 18 hours |
| I-1 | $Zn_5(OH)_8(NO_3)_2.2H_2O$ | 7 days |
| I-2 | $Zn_5(OH)_8(CH_3COO)_2.2H_2O$ | >14 days |
| I-3 | $Zn_5(OH)_8(Cl)_2.2H_2O$ | 6 days |
| I-4 | $(Zn_{5-x}, Co_x)(OH)_8(NO_3)_2.2H_2O$ | 2 days |
| I-5 | $3Zn(OH)_2.ZnSO_4.4H_2O$ | 2 days |
| I-6 | $[Zn_5(OH)_8(\text{1-naphthalene sulfonate})_y.xH_2O$ | >14 days |

TABLE 1-continued

| Coating | Particle | Fade Time |
|---|---|---|
| I-7 | $[Zn_5(OH)_8(Salicylate)_y]_x$ $[Zn_5(OH)_8(NO_3)]_{1-x}$ | >14 days |

The above results show that the salts employed in the elements employed in the present invention provide superior image stability to ink jet dyes against fade changes as compared to the control elements.

Example 2

Element 1

A coating composition was prepared from 70.0 wt. % of an aqueous colloidal suspension (15.8 wt. % solids) of $Zn_5(OH)_8(CH_3COO)_2.2H_2O$, 2.0 wt. % poly(vinyl alcohol) (Gohsenol® GH-17 from Nippon Gohsei Co.), and 28.0 wt. % water. The relative proportion of $Zn_5(OH)_8(CH_3COO)_2.2H_2O$ to PVA is therefore 85/15 by weight. The solution was coated onto a base support comprised of a polyethylene resin coated photographic paper stock, which had been previously subjected to corona discharge treatment, using a calibrated coating knife, and dried to remove substantially all solvent components to form the ink receiving layer.

Element 2

This element was prepared the same as Element 1 except that the coating composition was 73.5 wt. % of an aqueous colloidal suspension (15.0 wt. % solids) of $Zn_5(OH)_8(Cl)_2.2H_2O$, 2.0 wt. % poly(vinyl alcohol) (Gohsenol® GH-17 from Nippon Gohsei Co.), and 24.5 wt. % water. (The relative proportion of $Zn_5(OH)_8(Cl)_2.2H_2O$ to PVA is therefore 85/15 by weight).

Element 3

This element was prepared the same as Element 1 except that the coating composition was 14.8 wt. % $Zn_5(OH)_8(NO_3)_2.2H_2O$, 0.83 wt. % poly(vinyl alcohol) (Gohsenol® GH-23 from Nippon Gohsei Co.), 1.48 wt. % Dowfac 2A1® surfactant, and 82.9 wt. % water (The relative proportion of $Zn_5(OH)_8(NO_3)_2.2H_2O$ to PVA is therefore 95/5 by weight).

Element 4

This element was prepared the same as Element 1 except that the coating composition was 14.0 wt. % of an aqueous colloidal suspension of $Zn_5(OH)_8(CH_3COO)_2.2H_2O$ (15.8 wt. % solids), and 22.0 wt. % silica (a 40 wt. % aqueous colloidal suspension of Nalco2329® (75 nm silicon dioxide particles) from Nalco Chemical Co.), 2.0 wt. % poly(vinyl alcohol) (Gohsenol® GH-17 from Nippon Gohsei Co.), and 62.0 wt. % water. (The relative proportion of $Zn_5(OH)_8(CH_3COO)_2.2H_2O$ to silica is 20/80 and that of ($Zn_5(OH)_8(CH_3COO)_2.2H_2O$-silica) particles to PVA is therefore 85/15 by weight).

Element 5

This element was prepared the same as Element 1 except that the coating composition was 14.0 wt. % of an aqueous colloidal suspension of $Zn_5(OH)_8(CH_3COO)_2.2H_2O$ (15.8 wt. % solids), 22 wt. % fumed alumina (40 wt. % alumina in water, Cab-O-Sperse® PG003 from Cabot Corporation), 2.0 wt. % poly(vinyl alcohol) (Gohsenol® GH-17 from Nippon Gohsei Co.), and 62.0 wt. % water. (The relative proportion of $Zn_5(OH)_8(CH_3COO)_2.2H_2O$ to alumina is 20/80 and that of ($Zn_5(OH)_8(CH_3COO)_2.2H_2O$-alumina) particles to PVA is therefore 85/15 by weight)).

Element 6

This element was prepared the same as Element 1 except that the coating composition was 14.5 wt. % of an aqueous colloidal suspension of $Zn_5(OH)_8(Cl)_2.2H_2O$ (15.0 wt. % solids), 22.0 wt. % silica (a 40 wt. % aqueous colloidal suspension of Nalco2329® (75 nm silicon dioxide particles) from Nalco Chemical Co.), 2.0 wt. % poly(vinyl alcohol) (Gohsenol® GH-17 from Nippon Gohsei Co.), and 61.5 wt. % water. (The relative proportion of $Zn_5(OH)_8(Cl)_2.2H_2O$ to silica is 20/80 and that of ($Zn_5(OH)_8(Cl)_2.2H_2O$ -silica) particles to PVA is therefore 85/15 by weight).

Element 7

This element was prepared the same as Element 1 except that the coating composition was 14.5 wt. % of an aqueous colloidal suspension of $Zn_5(OH)_8(Cl)_2.2H_2O$ (15.0 wt. % solids), 22.0 wt. % fumed alumina (40 wt. % alumina in water, Cab-O-Sperse® PG003 from Cabot Corporation), 2.0 wt. % poly(vinyl alcohol) (Gohsenol® GH-17 from Nippon Gohsei Co.), and 61.5 wt. % water. (The relative proportion of $Zn_5(OH)_8(Cl)_2.2H_2O$ to alumina is 20/80 and that of ($Zn_5(OH)_8(Cl)_2.2H_2O$ -alumina) particles to PVA is therefore 85/15 by weight)

Comparative Element C-1 (Non-metal$^{2+}$ Hydroxide Salt)

This element was prepared the same as Element 1 except that the coating composition was 34.0 wt. % of silica (a 40 wt. % aqueous colloidal suspension of Nalco2329® (75 nm silicon dioxide particles) from Nalco Chemical Co.), 2.4 wt. % poly(vinyl alcohol), (Gohsenol® GH-23 from Nippon Gohsei Co.), and 63.6 wt. % water. (The relative proportions of silica to PVA are 85/15).

Comparative Element C-2 (Non-metal$^{2+}$ Hydroxide Salt)

This element was prepared the same as Element 1 except that the coating composition was 34.0 wt. % of a fumed alumina solution (40 wt. % alumina in water, Cab-O-Sperse® PG003 from Cabot Corporation), 2.4 wt. % poly (vinyl alcohol), (Gohsenol® GH-23 from Nippon Gohsei Co.), and 63.6 wt. % water. (The relative proportions of alumina to PVA are 85/15).

Printing and Dye Stability Testing

The above elements were printed using a Lexmark Z51 ink jet printer and a cyan inkjet ink, prepared using a standard formulation with a copper phthalocyanine dye (Clariant Direct Turquoise Blue FRL-SF), and a magenta ink, prepared using a standard formulation with Dye 6 from U.S. Pat. No. 6,001,161. The red channel density (cyan) patches and green channel density (magenta) patches at D-max (the highest density setting) were read using an X-Rite® 820 densitometer. The printed elements were then subjected to 1 day exposure to a nitrogen flow containing 5 ppm ozone, in the dark. The density of each patch was read after the exposure test using an X-Rite® 820 densitometer. The % dye retention was calculated as the ratio of the density after the exposure test to the density before the exposure test. The results for cyan and magenta D-max are reported in Table 2.

TABLE 2

| Element | Material | % dye retention magenta D-max | % dye retention cyan D-max |
|---|---|---|---|
| C-1 | $SiO_2$ | 14 | 85 |
| C-2 | $Al_2O_3$ | 25 | 93 |
| 1 | $Zn_5(OH)_8(CH_3COO)_2.2H_2O$ | 100 | 100 |
| 2 | $Zn_5(OH)_8(Cl)_2.2H_2O$ | 42 | 81 |
| 3 | $Zn_5(OH)_8(NO_3)_2.2H_2O$ | 100 | 100 |
| 4 | $Zn_5(OH)_8(CH_3COO)_2.2H_2O$/silica | 45 | 73 |
| 5 | $Zn_5(OH)_8(CH_3COO)_2.2H_2O$/alumina | 33 | 73 |
| 6 | $Zn_5(OH)_8(Cl)_2.2H_2O$/silica | 68 | 92 |

TABLE 2-continued

| Element | Material | % dye retention magenta D-max | % dye retention cyan D-max |
|---|---|---|---|
| 7 | $Zn_5(OH)_8(Cl)_2.2H_2O$/ alumina | 10 | 37 |

The above results show that the elements employed in the had better dye retention than the control elements.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method comprising the steps of:

A) providing an ink jet printer that is responsive to digital data signals;

B) loading said printer with an ink jet recording element comprising a support having thereon porous image-receiving layer comprising a polymeric binder, said porous image-receiving layer containing a metal hydroxide salt coated in particulate form, $$(M^{2+})(OH)_a(A^{p-})_b.xH_2O;$$

wherein:

$M^{2+}$ is at least one metal ion having a 2+ oxidation state, wherein M is zinc or tin;

A is an organic or inorganic anion;

p is 1 or 2; and x is equal to or greater than 0; and a and b comprise rational numbers as follows: $0<a<2$ and $0<b<2$ so that the charge of $M^{2+}$ is balanced wherein said metal hydroxide salt is in particulate form;

C) loading said printer with an ink jet ink composition; and

D) printing on said ink jet recording element using said ink jet ink composition in response to said digital data signals.

2. The method of claim 1 wherein said metal hydroxide salts is a zinc hydroxy double salt.

3. The method of claim 3 wherein $A^{p-}$ is an organic anion $R—COO^-$, $R—O^-$, $R—SO_3^-$, $R—OSO_3^-$ or $R—O—PO_3^-$ where R is an alkyl or aryl group.

4. The method of claim 1 wherein $A^{p-}$ is an inorganic anion $I^-$, $Cl^-$, $Br^-$, $F^-$, $ClO_4^-$, $NO_3^-$, $CO_3^{2-}$ or $SO_4^{2-}$.

5. The method of claim 1 wherein said metal hydroxide salt is prepared from an aqueous dispersion having a pH between about 3 and 10.

6. The method of claim 1 wherein M is Zn.

7. The method of claim 8 wherein $A^{p-}$ is Cl, $NO_3$, acetate, propionate or an organosulfonate.

8. The method of claim 9 wherein a is between and including 1.4 and 1.6, and b is between and including 0.4 and 0.6.

9. The method of claim 1 wherein the particle size of said metal hydroxide salt is less than about 5 $\mu$m.

10. The method of claim 1 wherein the particle size of said metal hydroxide salt is less than about 1 $\mu$m.

11. The method of claim 1 wherein said support is opague.

12. The method of claim 1 wherein said support is transparent.

13. The method of claim 1 which also includes a base layer located between said image-receiving layer and said support.

14. The method of claim 1 wherein said image-receiving layer contains a polymeric binder.

15. An ink jet printing method comprising the steps of:

A) providing an ink jet printer that is responsive to digital data signals;

B) loading said printer with an ink jet recording element comprising a support having thereon a porous image-receiving layer comprising a polymeric binder, said porous image-receiving layer containing a metal hydroxide salt coated in particulate form, $$(M^{2+})(OH)_a(A^{p-})_b.xH_2O;$$

wherein $M^{2+}$ is at least one metal ion having a 2+ oxidation state, wherein M is zinc;

A is an organic or inorganic anion;

p is 1 or 2 ; and x is equal to or greater than 0; and a and b comprise rational numbers as follows: $0<a<2$ and $0<b<2$ so that the charge of $M^{2+}$ is balanced wherein said metal hydroxide salt is in particulate form;

C) loading said printer with an ink jet ink composition; and

D) printing on said ink jet recording element using said ink jet ink composition in response to said digital data signals.

16. The method of claim 15 wherein a is greater than 0.5 and b is less than 1.5.

17. The method of claim 15 wherein the porous image-receiving layer is a product of coating the metal hydroxide salt as a colloidal dispersion of solid particulates.

* * * * *

UNITED STATES PATENT AND TRADEMARK OFFICE

CERTIFICATE OF CORRECTION

PATENT NO. : 6,984,033 B2
APPLICATION NO. : 10/180187
DATED : January 10, 2006
INVENTOR(S) : Bringley et al.

It is certified that error appears in the above-identified patent and that said Letters Patent is hereby corrected as shown below:

Column 9, line 46, Claim 3
" delete "claim 3" and replace with - - claim 1 - - .

Column 10, line 2, Claim 7
delete "claim 8" and replace with - - claim 6 - - .

Column 10, line 4, Claim 8
delete "claim 9" and replace with - - claim 7 - -.

Signed and Sealed this

Fifteenth Day of August, 2006

JON W. DUDAS
*Director of the United States Patent and Trademark Office*